US007180032B2

(12) United States Patent
Child et al.

(10) Patent No.: US 7,180,032 B2
(45) Date of Patent: Feb. 20, 2007

(54) CHANNELED WARMING MATTRESS AND MATTRESS PAD

(75) Inventors: Andrew D. Child, Moore, SC (US); Karen M. Green, Simpsonville, SC (US); Shawn Davis, Inman, SC (US); Keith M. Blackwell, Duncan, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/257,340

(22) Filed: Oct. 24, 2005

(65) Prior Publication Data

US 2006/0151456 A1 Jul. 13, 2006

Related U.S. Application Data

(60) Provisional application No. 60/643,354, filed on Jan. 12, 2005.

(51) Int. Cl.
*H05B 11/00* (2006.01)

(52) U.S. Cl. ..... 219/212; 219/211; 219/516; 219/528; 219/529; 219/545

(58) Field of Classification Search ..... 219/211–213, 219/505, 549, 528–529, 543–545, 516; 392/435, 392/437

See application file for complete search history.

(56) References Cited

U.S. PATENT DOCUMENTS 3,437,792 A * 4/1969 Lauck ..... 219/505
4,031,352 A 6/1977 Oosterberg ..... 219/212
4,058,704 A 11/1977 Shimizu ..... 219/528
4,061,827 A 12/1977 Gould ..... 428/368
4,162,393 A * 7/1979 Balboni ..... 219/217
4,198,562 A 4/1980 Mills et al. ..... 219/505
4,485,296 A 11/1984 Ueda et al. ..... 219/505
4,577,094 A 3/1986 Mills ..... 219/505
4,598,195 A 7/1986 Matsuo ..... 219/497
4,607,154 A 8/1986 Mills ..... 219/505
4,633,062 A 12/1986 Nishida et al. ..... 219/212
4,656,334 A 4/1987 Endo et al. ..... 219/212
4,677,281 A 6/1987 Mills ..... 219/505
4,855,572 A 8/1989 Wallgren et al. ..... 219/444.1
5,422,462 A 6/1995 Kishimoto ..... 219/545
5,484,983 A 1/1996 Roell ..... 219/545
5,581,192 A 12/1996 Shea et al. ..... 324/722
5,776,609 A 7/1998 McCullough ..... 428/375
5,804,291 A 9/1998 Fraser, Jr. ..... 428/283
5,824,996 A 10/1998 Kochman et al. ..... 219/529
5,837,164 A 11/1998 Zhao ..... 252/500
5,861,610 A 1/1999 Weiss ..... 219/497
5,902,518 A 5/1999 Khazai et al. ..... 252/511
5,916,506 A 6/1999 Breznak et al. ..... 264/104
5,952,099 A 9/1999 Asher et al. ..... 428/370
5,968,854 A 10/1999 Akopian et al. ..... 442/132
5,972,499 A 10/1999 Rodriguez et al. ..... 428/368

(Continued)

*Primary Examiner*—Robin Evans
*Assistant Examiner*—Vinod Patel
(74) *Attorney, Agent, or Firm*—Terry T. Moyer; Cheryl J. Brickey

(57) ABSTRACT

A warming mattress and mattress pad incorporating channeled areas for accepting heat and sensor wires. The inventive mattress and mattress pad includes an arrangement of seam structures defining channels housing substantially discrete elongate heating and sensing elements arranged in a substantially similar pattern within the mattress or mattress pad interior.

26 Claims, 7 Drawing Sheets

U.S. PATENT DOCUMENTS

| | | | | |
|---|---|---|---|---|
| 6,080,690 | A | 6/2000 | Lebby et al. | 442/209 |
| 6,090,313 | A | 7/2000 | Zhao | 252/500 |
| 6,093,908 | A | 7/2000 | Haag | 219/204 |
| 6,160,246 | A | 12/2000 | Rock et al. | 219/545 |
| 6,163,907 | A | 12/2000 | Larson | 5/691 |
| 6,172,344 | B1 | 1/2001 | Gordon et al. | 219/529 |
| 6,174,825 | B1 | 1/2001 | Dutt | 442/43 |
| 6,215,111 | B1 | 4/2001 | Rock et al. | 219/545 |
| 6,229,123 | B1 | 5/2001 | Kochman et al. | 219/549 |
| 6,242,094 | B1 | 6/2001 | Breznak et al. | 428/373 |
| 6,288,372 | B1 | 9/2001 | Sandberg et al. | 219/544 |
| 6,310,332 | B1 | 10/2001 | Gerrard | 219/505 |
| 6,369,369 | B2 * | 4/2002 | Kochman et al. | 219/545 |
| 6,381,482 | B1 | 4/2002 | Jayaraman et al. | 600/388 |
| 6,497,951 | B1 | 12/2002 | DeAngelis et al. | 428/364 |
| 6,563,094 | B2 * | 5/2003 | Kochman et al. | 219/549 |
| 6,582,456 | B1 | 6/2003 | Hand et al. | 607/108 |
| 6,680,117 | B2 | 1/2004 | DeAngelis et al. | 428/372 |
| 6,713,724 | B1 | 3/2004 | Carr et al. | 219/212 |
| 6,713,733 | B2 | 3/2004 | Kochman et al. | 219/549 |
| 6,756,572 | B2 | 6/2004 | Lee | 219/505 |
| 6,768,086 | B2 | 7/2004 | Sullivan et al. | 219/494 |
| 6,770,854 | B1 | 8/2004 | Keane | 219/529 |
| 6,914,216 | B1 | 7/2005 | Chen | 219/212 |
| 2001/0025846 | A1 | 10/2001 | Kochman et al. | 219/545 |
| 2002/0137831 | A1 | 9/2002 | Horibe et al. | 524/439 |
| 2003/0015285 | A1 | 1/2003 | Iwamoto et al. | 156/325 |

* cited by examiner

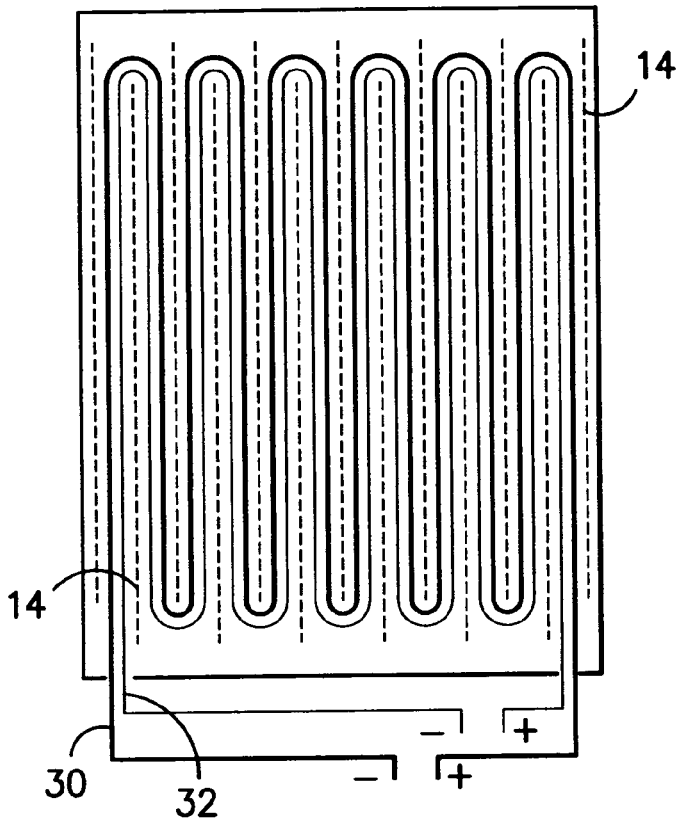
FIG. −4−
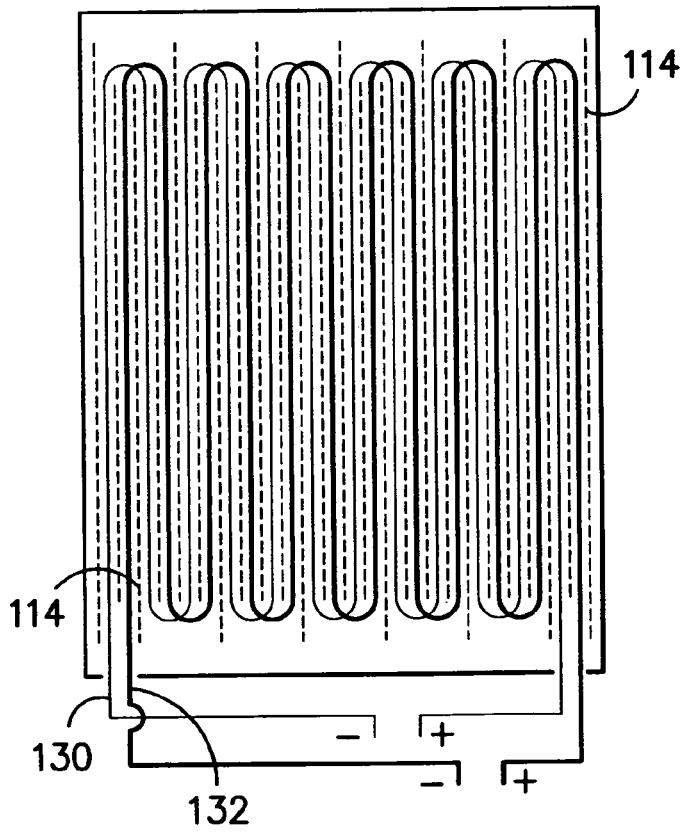
FIG. −5−

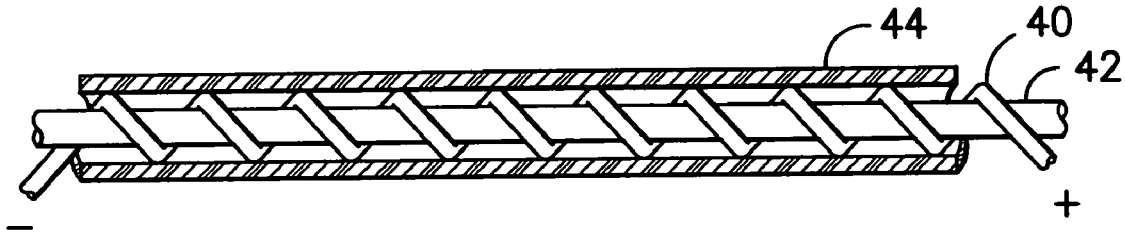
FIG. –6–
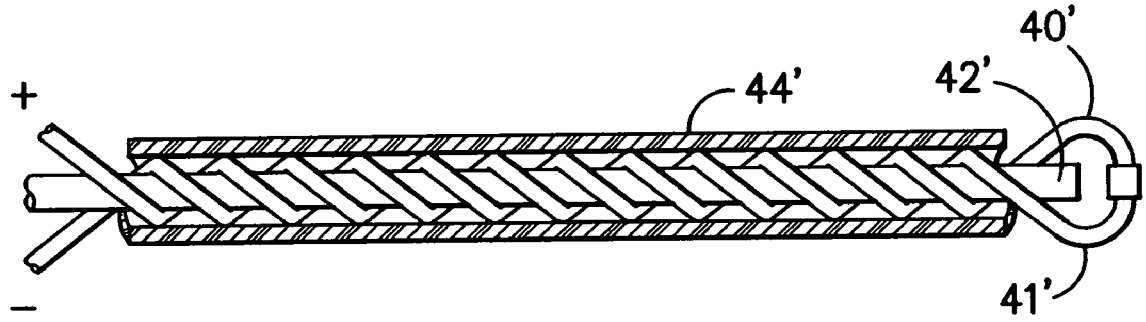
FIG. –7–

*FIG. —9—*

CHANNELED WARMING MATTRESS AND MATTRESS PAD

CROSS-REFERENCE TO RELATED APPLICATIONS

This application claims the benefit of and priority from U.S. Provisional Application 60/643,354, filed on Jan. 12, 2005 and Co-pending application Ser. No. 11/131,626, the contents of which are hereby incorporated by reference in their entirety as if fully set forth herein.

TECHNICAL FIELD

This invention relates generally to warming mattresses and mattress pads. More particularly, the invention relates to warming mattresses and mattress pads including channeled areas for accepting elongate heating and sensor elements. The heating and sensor elements are discrete from one another such that the sensor elements measure the bulk mattress and mattress pad temperature for regulated feedback control of the heating elements. Methods for forming the warming mattress and mattress pad and arranging the heating and sensor elements are also provided.

BACKGROUND

This invention generally relates to mattress and mattress pads that generate heat from electricity. During the winter in cold climates, an unoccupied bed becomes relatively cold. Thus a person entering the bed is exposed to bedding surfaces which are considerably colder than human body temperature. It takes some time for the person's body heat to warm the bed. In addition, the elderly or people with poor circulation may rely upon electric blankets or other similar equipment to warm them during the wintertime.

Various devices have been created to take the chill off of bedding so that a person upon entering the bed is not be exposed to cold surfaces in the winter. One common approach is to turn-on an electric blanket prior to entry into the bed to warm the region in which the person will sleep. Other devices supplied heated air into a space between the bed coverings. It would be desirable to have a warming mattress and mattress pad with heating and temperature sensing and control.

SUMMARY

The present invention provides advantages and/or alternatives over the prior art by providing warming mattresses and mattress pads incorporating substantially discrete elongate heating and sensing elements arranged in a substantially similar pattern within the mattress or mattress pad interior.

According to one contemplated practice the heating elements and sensing elements each incorporate one or more conductive metallic wires such as copper wire, copper alloy wire or the like in wrapped relation around a core of polymeric fiber or the like with an insulating jacket surrounding the core and wrapped wire. The discrete elongate heating elements and sensing elements are threaded through common channels at the interior of the mattress or mattress pad in a common pattern such that the heating elements and sensing elements run in substantially parallel relation to one another.

According to another contemplated practice the heating elements and sensing elements each incorporate one or more conductive metallic wires such as insulated copper wire or the like in wrapped relation around a core of polymeric fiber or the like with an insulating jacket surrounding the core and wrapped wire. The discrete elongate heating elements and sensing elements are threaded through parallel channels at the interior of the mattress or mattress pad in a pattern such that channel walls separate the heating elements and sensing elements over at least a portion of the pattern.

BRIEF DESCRIPTION OF THE DRAWINGS

The present invention will now be described by way of example only, with reference to the accompanying drawings which constitute a part of the specification herein and in which:

FIG. 4 is an exemplary pattern for threading heating and sensing elements through common channels within a warming mattress or mattress pad;

FIG. 5 is an exemplary pattern for threading heating and sensing elements through discrete channels within a warming mattress or mattress pad;

FIG. 6 is a cut-away view of a wrapped wire construction for use as a heating or sensing element utilizing a single wire wrapped around a fiber core;

FIG. 7 is a cut-away view of a wrapped wire construction for use as a heating or sensing element utilizing two wires wrapped around a fiber core;

DETAILED DESCRIPTION

Figure 1:
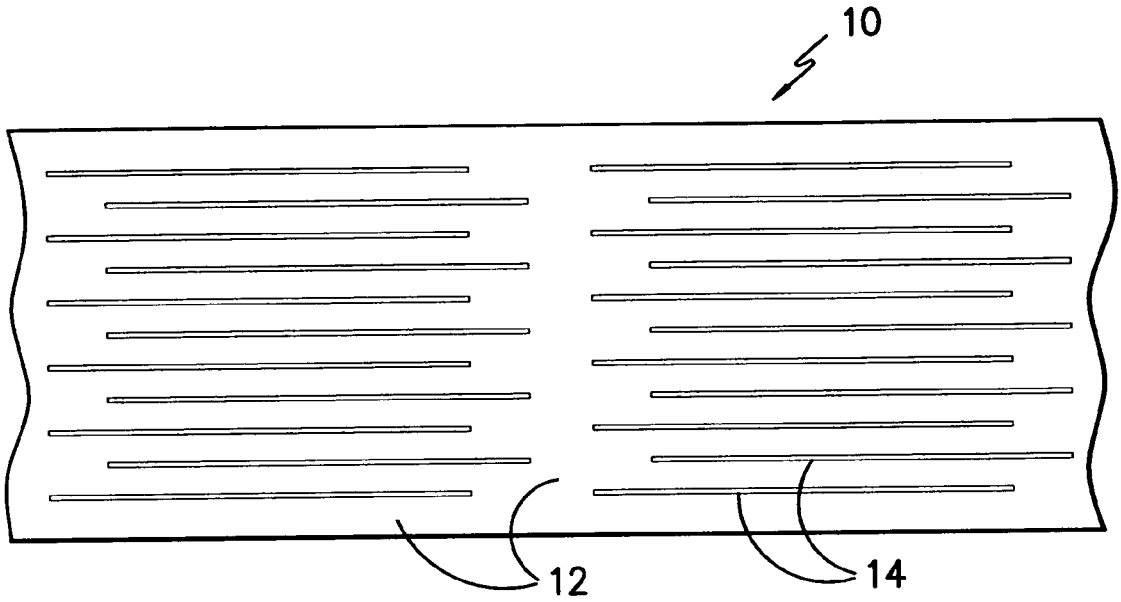
FIG. 1 is an overhead view of an exemplary warming mattress or mattress pad composite showing a channel pattern.

Exemplary embodiments of the invention will now by described by reference to the drawings wherein like elements are designated by corresponding reference number throughout the various views. All referenced patent documents are hereby incorporated by reference as if fully set forth herein. Referring now to the figures, in FIG. 1, a warming mattress or mattress pad heating element 10 (shell structure) is shown incorporating a pattern of channels 12 defined between elongate seam structures 14. The elongate seam structures 14 preferably connect together layers within the heating element 10 so as to define a pattern of barrier walls between the channels 12. The seam structures 14 may be of any suitable construction including woven seams, sewn seams, adhesive seams, welded seams and the like. Adhesives such as curable urethane or the like may potentially be preferred.

While this invention is directed towards warming mattresses and mattress pads, it may also be used in warming blankets, comforters, duvets, pillows, or the like.

Figure 2:
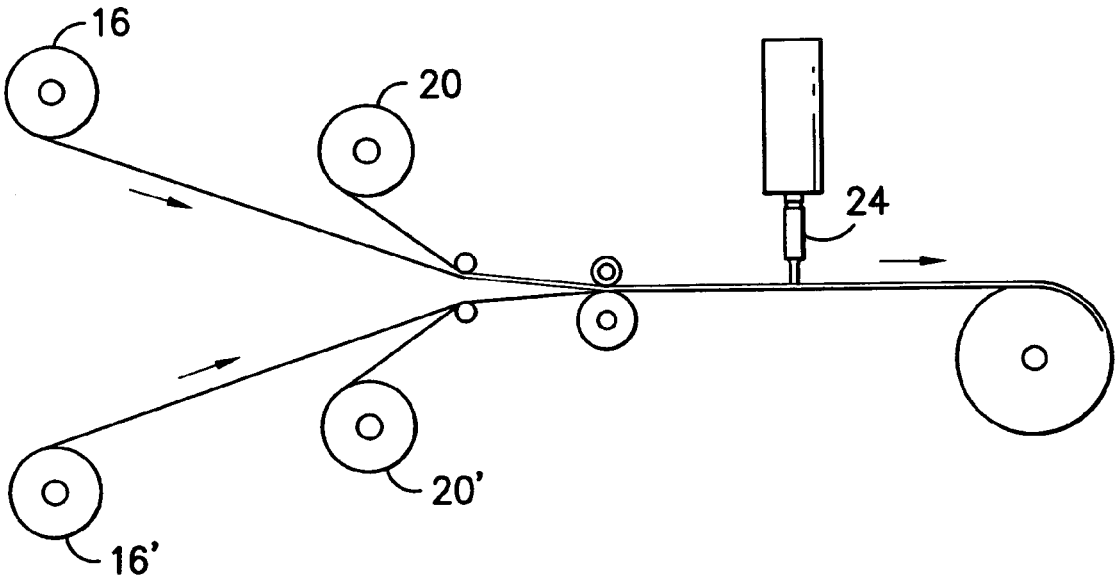
FIG. 2 is a schematic view illustrating an exemplary formation line for applying a channel pattern to a multi-layer mattress or mattress pad.

One practice for forming a potentially desirable mattress pad shell structure incorporating woven seams is illustrated in FIG. 2 for one embodiment of a mattress pad. In the illustrated arrangement, let-off rolls are arranged such that two needle punch batting layers 16 and 16' are brought together in adjacent opposing relation to one another. The batting layers 16 and 16' are preferably needle punch fabric layers, but may be other layers such as non-woven fibrous layers or other batting layers depending on the construction of the mattress pad. In a potentially preferred practice the layers 16, 16' may be formed of fibers including polyester, polypropylene, or other natural or synthetic batting materials. Although the weight of the inner layers can vary greatly, the layers should be of sufficient strength to provide a stable channel for wiring without increasing the composite stiffness significantly. The layers 16 and 16' may have a weight of approximately 1.0 and 5.0 ounces per yard. This provides a low stretch, low friction channel and batting through which to insert the wire.

Figure 10:
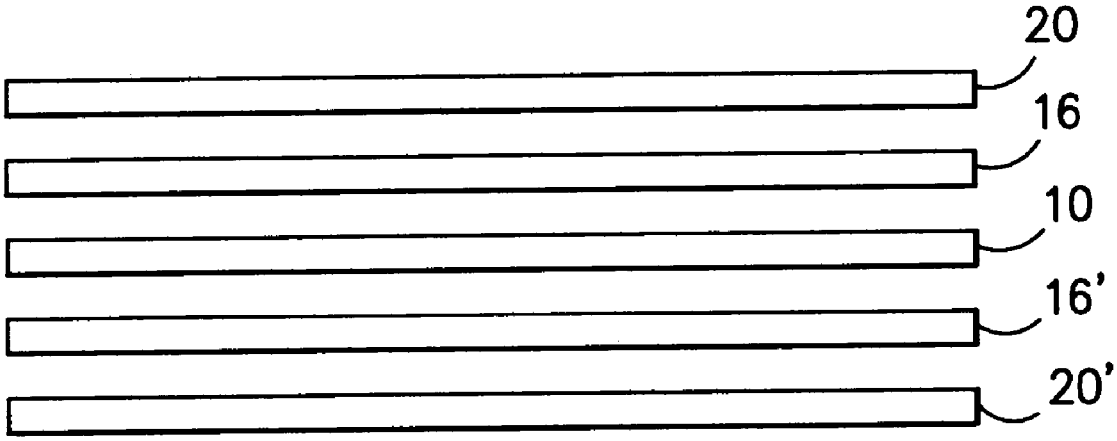
FIG. 10 is a cross-sectional view of one embodiment of the mattress pad.

In other embodiment, an optional additional high loft batting layer may be used in place of one or both of the needle punch batting layers. If a high loft batting layer is used, it is preferred to use a spunlace or spunbond nonwoven fabric between the high loft batting layer(s) and the heating element to have easier threading of the wires. It is contemplated that the shell fabrics are preferably warp knit, circular knit, nap knit micro-denier, woven, non-woven or needle punch construction formed from suitable fibrous materials including polyester, polypropylene or the like. It is also contemplated that the needle punch batting layers 16, 16' and/or the optional high loft batting layer may be eliminated or replaced with other suitable materials if desired. The preferable mass per unit area for the decorative shell fabric layer is in the range from about 2.5 oz/yd$^2$ to about 6.0 oz/yd$^2$. The optional high loft batting layer is preferably a relatively high loft material for thermal insulation. For a mattress or mattress pad, the outer shell fabric layer 20' defines the bottom of the of the mattress or mattress pad so that the batting traps the heat generated and radiates such heat upwards towards the user laying on the mattress or mattress pad. Furthermore, the batting is particularly useful in creating both a three-dimensional structure to the final composite and in masking the tactile perception of the heating wires by the user. The high loft batting is preferably a polyester resin-bond with a loft of between 0.125 inches and 0.50 inches. It should have adequate wash stability, and should not contribute to the overall flammability of the composite. The channels are sewn by sewing needle 24. The mattress pad also includes an extendable elastic around at least a portion of the outer edge of the mattress pad (not shown) to keep the mattress pad on the mattress. Preferably, the conductive wires in the heating element substantially cover the enter surface of mattress when the mattress pad is applied to the mattress. FIG. 10 shows the cross-section of a mattress pad made according to the process in FIG. 2 after the heating element is inserted.

Figure 3:
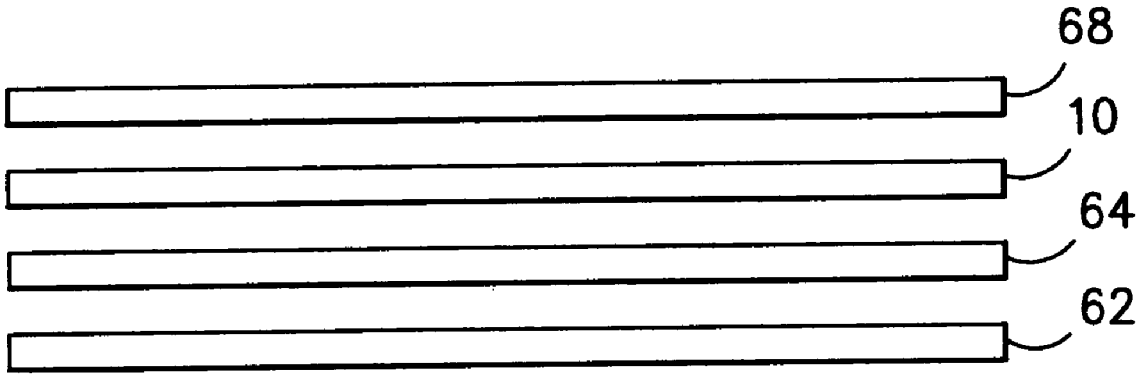
FIG. 3 is a cross-sectional view of one embodiment of the mattress.

FIG. 3 shows a cross-section of one embodiment of the warming mattress. It comprises a support layer 62, a cushioning layer 64, a heating element 10 and a ticking layer 68. The support layer 62 may be any known support layer for a mattress such as metal springs, air, or foam. The cushioning layer 64 is typically made up of foam or fiber batting. The heating element 10 is described in greater detail below. There may be an additional batting layer between the heating element and the ticking layer (not shown). The ticking layer 68 is typically the outside fabric covering the mattress and may be a decorative fabric. The preferable mass per unit area for the ticking layer 68 is in the range from about 2.5 oz/yd$^2$ to about 6.0 oz/ yd$^2$. In another embodiment of the invention, the heating element has an outer surface that can be the outer surface of the mattress, performing the same function as a ticking layer, eliminating the need for a separate ticking layer.

A fire retardant layer may be incorporated into the mattress and/or mattress pad. For the mattress, the flame retardant layer may be above or below the heating element 10. In the case that the heating element is the outer layer of the mattress, the fire retardant layer will be below the heating element. Fire retardant chemistries are well known and may be used as the flame retardant layer in the invention. A preferred fire barrier material is an aramid fiber which is made by E.I. DuPont de Nemours & Co. and sold as KEVLAR. Other known fire barrier materials which are known are preoxidized acrylic and fiberglass.

Regardless of the formation technique or layer pattern utilized, the resulting heating element 10 (a shell structure) is preferably characterized by a predefined pattern of channels through which elongate heating and sensor elements may be threaded. A first exemplary arrangement of channels containing a patterned arrangement of elongate heating and sensor elements is illustrated in FIG. 4. As shown, in this construction the seam structures 14 run in parallel relation to one another in the length direction of the mattress or mattress pad. The seam structures 14 define boundaries for interior channels through which a discrete elongate heating element 30 and a discrete elongate sensing element 32 are threaded in a desired pattern such as the illustrated arrangement. In the illustrated construction the elongate heating element 30 and the elongate sensing element 32 follow a common pattern thereby remaining substantially parallel to one another while extending through common channels. If desired, the elongate heating element 30 and the elongate sensing element 32 may cross at localized points such as where they reverse direction at the top and bottom of the pattern while nonetheless maintaining a common pattern.

A second exemplary arrangement of channels containing a patterned arrangement of elongate heating and sensor elements is illustrated in FIG. 5 wherein elements corresponding to those previously described are designated by like reference numerals increased by 100. As shown, in this construction a higher concentration of seam structures 114 is utilized with the elongate heating element 130 and the elongate sensing element 132 running through separate channels separated by the seam structures 114. Thus, while the elongate heating element 130 and the elongate sensing element 132 utilize the same pattern running from end to end of the mattress or mattress pad, there is a slight phase shift between the two patterns. Physical separation between the elongate heating element 130 and the elongate sensing element 132 is maintained by the seam structures 114. Thus, as with the embodiment of FIG. 4, the elongate heating element 130 and the elongate sensing element 132 are disposed in substantially parallel relation to one another with the channels. As shown, the elongate heating element 130 and the elongate sensing element 132 may cross at localized points such as where they reverse direction at the top and bottom of the pattern while nonetheless maintaining the desired common pattern.

Although they perform different functions, the elongate heating element and the elongate sensing element may be of substantially similar construction. By way of example only, and not limitation, constructions for such elongate elements are illustrated in FIGS. 6 and 7. In the construction illustrated in FIG. 6, a single conductive metallic wire 40 such as copper or the like extends in wrapped relation around a flexible core 42 such as a polymeric fiber or the like. The metallic wire 40 may be formed of any suitable material including copper, copper alloys, and other ferrous and nonferrous metals including nickel, steel, and the like. According to one contemplated practice, the metallic wire 40 may be a copper alloy wire such as is available from Fisk Alloy having a thickness of about 33 to about 42 American wire gauge (awg). The metallic wire 40 may be wrapped around a PET textile core having a linear density of about 500 to about 1000 denier. An insulating layer 44 such as PVC or the like extends in surrounding relation to the wrapped structure. It has been found that elongate structures of such construction exhibit substantial flexibility without undue levels of strain hardening so as to permit their insertion in a desired pattern without undue strain hardening and embrittlement. If desired, the metallic wire 40 may also include a nonconductive coating such as enamel or the like. However, metallic wires without such coating may also be utilized if desired.

In the construction illustrated in FIG. 7, a pair of conductive metallic wires 40', 41' such as previously described extends in wrapped relation around a flexible core 42' such as a polymeric fiber or the like. In all other respects the structure is substantially identical to that of FIG. 6. Such structures exhibit substantial flexibility with sufficient structural stability to be threaded through channels within the mattress or mattress pad. A potential benefit is that the two wires may be connected together at one end of the structure as shown thereby completing a circuit so that only one end of the elongate structure needs to be available to the heating or sensing circuit.

Figure 8:
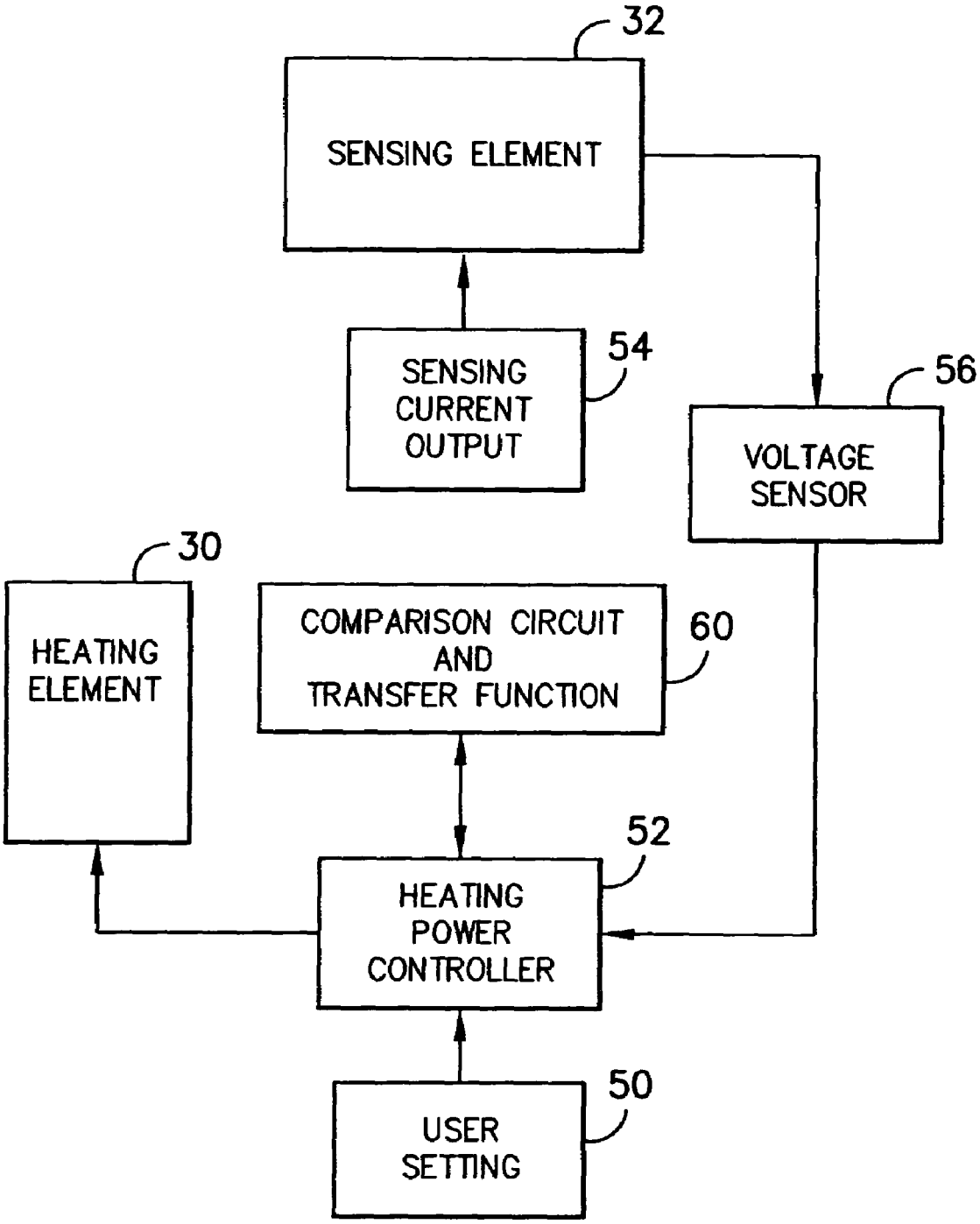
FIG. 8 is a diagram representing operation of the warming mattress or mattress pad.

As illustrated in FIG. 8, according to one contemplated practice, a user will connect the system to a power source and select a desired user setting 50 such as a dial setting of 1 to 10 or specific desired temperature to activate the system. A signal is sent from the user setting 50 to a heating power controller 52 for delivery of current to the heating element 30, 130. In conjunction with activation of the system, a sensing current output 54 is delivered to the elongate sensing element 32, 132. During application of the sensing current a voltage sensor measures the voltage across the sensing element and transmits that data to the heating power controller. Based on the known sensing current output and the measured voltage across the sensing element, the heating power controller calculates the temperature of the sensing element based on a comparison circuit and transfer function 60 and/or a look-up table programmed into the controller. Based on the measured temperature of the sensing element, the heating power controller then adjusts the current flow to the heating element as necessary to achieve the selected user setting. This process is performed continuously to achieve and maintain a desired steady state temperature.

As previously indicated, in the present invention the elongate heating element 30,130 and elongate sensing element 32, 132 are substantially discrete from one another rather than being contained within a common elongate structure. However, they are nonetheless arranged in a common pattern in substantially parallel relation to one another within the mattress or mattress pad. The use of such discrete heating and sensing elements arranged in common patterns with one another has been shown to provide a dramatically improved ability to maintain a steady state temperature within the blanket as the room temperature changes.

In order to demonstrate the benefits of the present mattress and mattress pad invention, temperature data was collected on warming blankets with different wiring arrangements within a temperature controlled room. These test blankets have the same wire configurations and electronics that would be used for the corresponding warming mattress or mattress pad. The test blankets were identical to one another in all respects except for the wiring. The test blankets were set at an initial setting and left at that setting throughout the test. The room temperature was cycled from an initial set point of 75 degrees Fahrenheit. The first hour was at 75 degrees Fahrenheit, the next hour the room temperature was reduced to 65 degrees Fahrenheit, then increased back to 75 degrees Fahrenheit, and finally increased to 85 degrees Fahrenheit. Blanket temperature was measured throughout the test to see how well the blanket sensed the room temperature and then responded. The test samples were: (1) a commercial warming blanket having a heating and sensor wire arranged in a common sleeve running in a sinusoidal pattern, (2) a warming blanket that is believed to be formed according to the teachings in U.S. Pat. No. 6,686,561, (3) a warming blanket incorporating separate discrete elongate heating and sensing elements arranged through common interior channels in a pattern as shown in FIG. 4, a warming mattress or mattress pad incorporating separate discrete elongate heating and sensing elements arranged through separate interior channels in a pattern as shown in FIG. 5.

Figure 9:
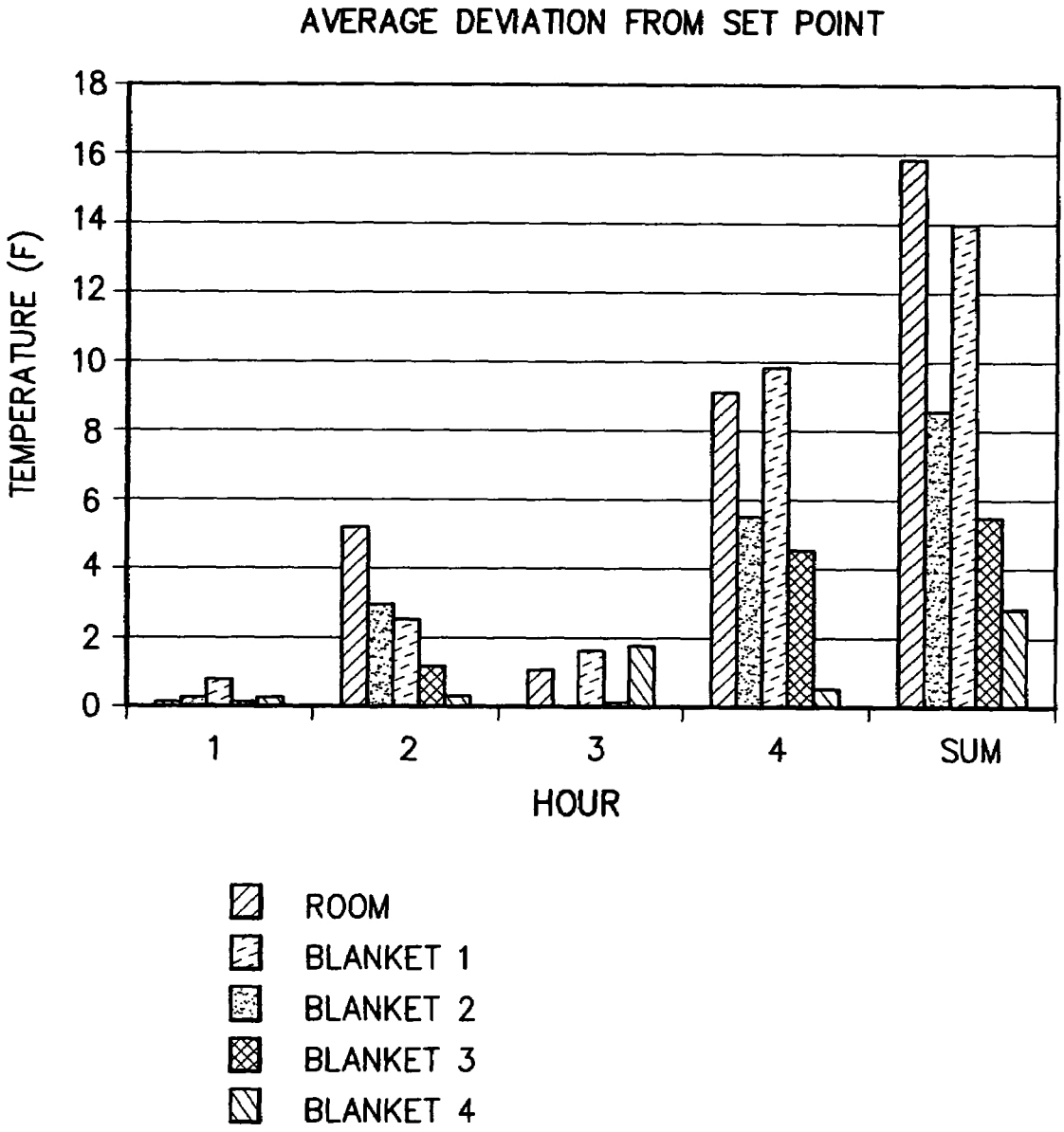
FIG. 9 is a bar chart illustrating comparative performance of various mattress or mattress pad constructions in holding a steady temperature during variations of room temperature.

Performance was evaluated based on the deviation of the blanket temperature from the initial set point of 75 degrees Fahrenheit. A perfect blanket would have the same temperature regardless of what the room temperature was resulting in a value of zero deviation. A blanket with poor temperature control would substantially follow room temperature and have approximately the same value of deviation as the room. FIG. 9 is a bar chart showing the average deviation values for the room and for each blanket relative to the initial 75 degree Fahrenheit at the different time points, and a final summation of the deviations. The summation of the deviations is believed to be the clearest identifier of the blanket performance. As demonstrated, blankets 3 and 4 provided superior performance in maintaining a steady temperature when subjected to changes in room temperature with blanket 4 providing the best results of any blanket tested. These learnings can be applied to mattresses and mattress pads.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the invention.

What is claimed is:

1. A mattress, comprising:

a support layer;

a cushioning layer; and a heating element; wherein the heating element comprises a first textile panel end a second textile panel operatively joined together by a plurality of seam structures defining an arrangement of channels extending in a pattern between the first textile panel and the second textile panel;

an elongate heating element extending through at least a potion of the channels; and an elongate sensing element discrete from the elongate heating element extending through at least a portion of the channels, wherein the elongate heating element and the elongate sensing element are arranged in substantially common pattern arrangements such that the portions of the elongate heating element and the elongate sensing element within the channels are disposed in substantially parallel orientation to one another.

2. The invention as recited in claim 1, wherein at least one of the elongate heating element and the elongate sensing element comprises a metallic wire disposed in wrapped relation to a textile fiber core with an insulating sleeve disposed in surrounding relation to the wrapped wire and fiber core.

3. The invention as recited in claim 1, wherein each of the elongate heating element and the elongate sensing element comprises a metallic wire disposed in wrapped relation to a textile fiber core with an insulating sleeve disposed in surrounding relation to the wrapped wire and fiber core.

4. The invention as recited in claim 1, wherein at least one of the elongate heating element and the elongate sensing element comprises a pair of metallic wires disposed in wrapped relation to a textile fiber core with an insulating sleeve disposed in surrounding relation to the wrapped wires and fiber core.

5. The invention as recited in claim 1, wherein each of the elongate heating element and the elongate sensing element comprises a pair of metallic wires disposed in wrapped relation to a textile fiber core with an insulating sleeve disposed in surrounding relation to the wrapped wires and fiber core.

6. The invention as recited in claim 1, wherein the elongate heating element and the elongate sensing element extend through common channels.

7. The invention as recited in claim 6, wherein the elongate heating element and the elongate sensing element are arranged in a common sinusoidal pattern.

8. The invention as recited in claim 1, wherein at least portions of the elongate heating element and the elongate sensing element extend through different channels such that seam structures separate said portions of the elongate heating element and the elongate sensing element from one another.

9. The invention as recited in claim 8, wherein the elongate heating element and the elongate sensing element are arranged in common sinusoidal patterns shifted out of phase relative to one another.

10. The invention as recited in claim 1, wherein the plurality of seam structures run at least partially along the length of the mattress.

11. The invention as recited in claim 1, wherein the elongate sensing element extends through a different portion of the channels.

12. The invention as recited in claim 1, wherein the mattress further comprises a flame retardant layer.

13. The invention as recited in claim 1, wherein the mattress further comprises a ticking layer.

14. A mattress pad, comprising:

a top fabric layer;

a first batting layer;

a heating element;

a bottom fabric layer; and an extendable elastic around at least a portion of the outer edge of the mattress pad, wherein the heating element comprises a first textile panel and a second textile panel operatively joined together by a plurality of seam structures defining an arrangement of channels extending in a pattern between the first textile panel and the second textile panel;

an elongate heating element extending through at least a potion of the channels; and an elongate sensing element discrete from the elongate heating element extending through at least a portion of the channels, wherein the elongate heating element and the elongate sensing element are arranged in substantially common pattern arrangements such that the portions of the elongate heating element and the elongate sensing element within the channels are disposed in substantially parallel orientation to one another.

15. The invention as recited in claim 14, wherein at least one of the elongate heating element and the elongate sensing element comprises a metallic wire disposed in wrapped relation to a textile fiber core with an insulating sleeve disposed in surrounding relation to the wrapped wire and fiber core.

16. The invention as recited in claim 14, wherein each of the elongate heating element and the elongate sensing element comprises a metallic wire disposed in wrapped relation to a textile fiber core with an insulating sleeve disposed in surrounding relation to the wrapped wire and fiber core.

17. The invention as recited in claim 14, wherein at least one of the elongate heating element and the elongate sensing element comprises a pair of metallic wires disposed in wrapped relation to a textile fiber core with an insulating sleeve disposed in surrounding relation to the wrapped wires and fiber core.

18. The invention as recited in claim 14, wherein each of the elongate heating element and the elongate sensing element comprises a pair of metallic wires disposed in wrapped relation to a textile fiber core with an insulating sleeve disposed in surrounding relation to the wrapped wires and fiber core.

19. The invention as recited in claim 14, wherein the elongate heating element and the elongate sensing element extend through common channels.

20. The invention as recited in claim 19, wherein the elongate heating element and the elongate sensing element are arranged in a common sinusoidal pattern.

21. The invention as recited in claim 14, wherein at least portions of the elongate heating element and the elongate sensing element extend through different channels such that seam structures separate said portions of the elongate heating element and the elongate sensing element from one another.

22. The invention as recited in claim 21, wherein the elongate heating element and the elongate sensing element are arranged in common sinusoidal patterns shifted out of phase relative to one another.

23. The invention as recited in claim 14, wherein the plurality of seam structures run at least partially along the length of the mattress pad.

24. The invention as recited in claim 14, wherein the elongate sensing element extends through a different portion of the channels.

25. The invention as recited in claim 14, wherein the mattress pad further comprises a flame retardant layer.

26. The invention as recited in claim 14, wherein the mattress pad further comprises a second batting layer.

* * * * *

UNITED STATES PATENT AND TRADEMARK OFFICE

CERTIFICATE OF CORRECTION

PATENT NO. : 7,180,032 B2
APPLICATION NO. : 11/257340
DATED : February 20, 2007
INVENTOR(S) : Andrew D. Child It is certified that error appears in the above-identified patent and that said Letters Patent is hereby corrected as shown below:

Column 6, Line 65 After "a" and before "of", delete "potion" and add --portion--

Signed and Sealed this

First Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,180,032 B2
APPLICATION NO. : 11/257340
DATED : February 20, 2007
INVENTOR(S) : Child et al.

It is certified that error appears in the above-identified patent and that said Letters Patent is hereby corrected as shown below:

Title Page;

Please insert -- (63) Related U.S. Application Data. "Continuation-in-part of application No. 11/131,626, filed on May 18, 2005, now Patent No. 7,038,170." --

Signed and Sealed this

Twenty-eighth Day of August, 2007

JON W. DUDAS
*Director of the United States Patent and Trademark Office*